US006041553A

United States Patent [19]

Joyce et al.

[11] Patent Number: 6,041,553

[45] Date of Patent: Mar. 28, 2000

[54] ANCHORAGE SYSTEM FOR A HORIZONTAL DOOR

[75] Inventors: Roger F. Joyce, Guilford; Dominic T. DeConciliis, Madison, both of Conn.

[73] Assignee: The Bilco Company, West Haven, Conn.

[21] Appl. No.: 09/057,262

[22] Filed: Apr. 8, 1998

[51] Int. Cl.[7] ..... E06B 1/04

[52] U.S. Cl. ..... 49/504; 52/204.55

[58] Field of Search ..... 49/504, 386, 387; 52/19, 20, 21, 204.55, 712

[56] References Cited

U.S. PATENT DOCUMENTS

| | | | |
|---|---|---|---|
| 901,536 | 10/1908 | Kennelly | 52/21 |
| 3,698,146 | 10/1972 | Brents . | |
| 3,797,187 | 3/1974 | Cennerelli . | |
| 3,896,595 | 7/1975 | Anghinetti et al. . | |
| 3,999,339 | 12/1976 | Sappenfield . | |
| 4,115,968 | 9/1978 | Majumdar . | |
| 4,429,495 | 2/1984 | Aoki | 49/504 X |
| 4,617,771 | 10/1986 | Tomaszewski . | |
| 4,958,469 | 9/1990 | Plummer | 52/204.55 |
| 4,999,957 | 3/1991 | Kessler . | |
| 5,136,811 | 8/1992 | Lyons, Sr. . | |
| 5,205,073 | 4/1993 | Lyons, Sr. . | |
| 5,301,469 | 4/1994 | Lyons, Sr. . | |
| 5,515,658 | 5/1996 | Jorde . | |
| 5,551,189 | 9/1996 | Westfall . | |
| 5,572,840 | 11/1996 | Fast et al. . | |
| 5,669,198 | 9/1997 | Ruff . | |

FOREIGN PATENT DOCUMENTS

| | | | |
|---|---|---|---|
| 2625986 | 12/1977 | Germany | 49/387 |

OTHER PUBLICATIONS

Engineering Drawings by J.J.K., Sep. 12, 1997.

*Primary Examiner*—Jerry Redman
*Attorney, Agent, or Firm*—DeLio & Peterson, LLC

[57] ABSTRACT

Horizontal hinged door assemblies such as sidewalk doors comprising a door, a frame surrounding the door and a hinge connecting the door to the frame are improved by utilizing an anchor device which is inserted into an opening in at least one of the frame walls forming an outwardly extending flange for securing the door assembly to the structure forming the opening to be covered. The anchor device may be inserted into the frame during fabrication of the door assembly or on-site during installation of the door assembly. A variety of elongated shaped anchor devices may be used depending on the type door assembly installation. The anchor devices are preferably bendable to conform the anchor device to the site to which the door is being secured.

11 Claims, 4 Drawing Sheets

ANCHORAGE SYSTEM FOR A HORIZONTAL DOOR

BACKGROUND OF THE INVENTION

1. Field of the Invention

This invention relates to horizontal hinged door assemblies and, in particular, to such door assemblies as sidewalk access doors which comprise a door, a frame surrounding the door, preferably a peripheral channel frame to restrict water and dirt from falling through to the area below covered by the door, and a hinge connecting the door to the frame for rotation about an axis. The frame is positioned at the periphery of the opening to be enclosed and secured to a concrete slab or to another structure such as a floor or ceiling and concrete is typically poured around the frame to the top of the frame to anchor the frame and provide for the door and surrounding area, e.g., sidewalk, to be at the same level.

2. Description of Related Art

Horizontal hinged (covers) doors are commonly used for access doors, roof scuttles, automatic fire vents, ceiling access doors, basement doors and for pit, floor and sidewalk doors for access to subterranean locations. While the present description will be directed to pit, floor and sidewalk doors, it will be appreciated that the invention can be used for any such horizontal doors where the frame of the door is secured at the opening to the ground or a concrete slab, mounted to a structure such as a floor or ceiling, cemented in place in a sidewalk, etc.

Pit, floor and sidewalk doors are used in a variety of applications for providing access through openings in a concrete slab, wood floor or ceiling, and the like into a pump pit, utility vault, pipe trench, basement, building, etc. Most of the designs for these type doors utilize a channel frame surrounding the door which frame may be connected to a drain. The typical door assembly has a gap between the frame and the door due to manufacturing tolerances and operational clearances through which gap water and dust enters and the drain and channel directs rain water away and prevents dirt from falling through to the covered area below.

The channel frame is usually made of metal such as extruded aluminum and is generally a U-shape. The thickness of the frame is usually up to about ½ inch, typically ¼ inch. The dimensions of the U-shaped channel may vary widely up to, for example, 5 inch high by 5 inch wide or larger. A typical U-frame is made of ¼ inch thick extruded aluminum with the frame being about 3.5 inch high by 3 inch wide. The channel frame is made as a continuous extrusion and is cut to the proper length and the four sides of the assembly connected together to form the frame. The frame is positioned at the periphery of the hole opening to which the frame is secured. The top of the outer wall of the channel frame typically has an inward flange extending around the periphery of the channel for strength and to facilitate hinge connection to the door. The height of the inner wall of the frame is generally slightly lower than the outer wall to accommodate the thickness of the door when the door is closed. The door is generally up to about ⅜ inch thick, typically ¼ inch. When the door is in the closed position, the door rests on the inner wall and the door is flush with the inward flange of the channel frame.

The door covers an opening and the frame of the door assembly must be secured to the ground, concrete slab, floor, or other structure forming the opening. Accordingly, the door frame is placed at the periphery of opening and secured, for example, by cement poured around the outer wall of the door frame or otherwise secured to the structure by fasteners such as bolts, screws and the like. For sidewalk type doors, the level of the cement, floor, or other structure is essentially the same height as the door in the closed position. To secure the door assembly, most door assemblies are constructed with a flange extending outwardly from the outer wall of the channel frame to provide an anchor with the cement or other fastener used to secure the frame. Such flanges are shown in U.S. Pat. Nos. 5,205,073 and 5,301,469 wherein a horizontal door is shown secured in cement. Both patents are assigned to the assignee of the present invention and both are incorporated herein by reference.

Horizontal doors are generally installed on-site and there are a number of structure openings with which the contractor must contend with when installing the door assembly. For example, the door might be positioned on a concrete slab or on dirt or on a roof of a building. The anchor flanges normally integral with the door frame may be in a position on the frame which is inconvenient for the particular installation such as when the structure or ground to which it is secured is uneven. On-site installation is accordingly very difficult and skilled workers or other on-site preparation are usually required to properly install a horizontal door, which adds significantly to the cost of the installation at any site location such as when the site is uneven.

Bearing in mind the problems and deficiencies of the prior art, it is one object of the present invention to provide an anchor device for use to anchor horizontal hinged doors which devices are adjustable and which may be readily used by unskilled workers for any type door installation at any site location such as when the site is uneven.

It is a further object of the invention to provide an anchor device for use to anchor horizontal hinged doors which anchor device is economical to manufacture, easy to use both in fabricating the door assembly in the factory with the anchor device in place and on-site when installing the door assembly and which device may be used with any type horizontal door assemblies.

It is an additional object of the invention to provide a horizontal hinged door assembly having a bendable anchor device as part of the assembly which door assembly is economical to manufacture and relatively easy to install on-site by unskilled workmen.

It is another object of the invention to provide a horizontal hinged door assembly and/or a frame member used to make horizontal door assemblies which are adapted to utilize an anchor device of the invention for easy installation of the door assembly at the site of the installation.

It is another object of the invention to provide a method for installing a horizontal hinged door assembly using anchoring devices attached to the frame of the floor assembly and/or connected to the frame of the floor assembly during on-site installation.

Other objects and advantages will be apparent from the following description.

SUMMARY OF THE INVENTION

The present invention comprises a horizontal hinged door assembly for enclosing an opening and which door assembly may be easily installed on-site, the door assembly comprising:

a plurality of elongate frame members, preferably comprising a channel frame and U-shaped, which frame members are connected together to form a frame for the door assembly and which frame is secured to a structure forming the opening, the frame members having opposed outer and inner walls and a connecting lower wall and at least one opening or recess in the outer surface of any or all of the walls of at least one of the frame members preferably in all of the frame members;

a hinge;

a door hingedly mounted to a frame member for motion between an open and closed position; and an elongate anchor device comprising a leg portion which is inserted into any of the openings and a body portion which extends outwardly from the wall of the frame member and which body portion of the anchor device is secured to the structure forming the opening to provide an installed door assembly.

The frame member is preferably a channel frame and is generally U-shaped and preferably has a transverse inwardly extending flange at the upper end of the outer wall which extends partially into the channel opening formed by the channel frame. The frame member may comprise other shapes as is well known in the art. The height of the inner wall of the channel frame is slightly lower than the height of the outer wall to accommodate the door when closed so that the closed door is flush with the upper end and flange of the outer wall of the channel frame.

The anchor devices may be of any shape to accommodate the structure to which the door assembly is secured and of a material and thickness sufficient to provide the necessary strength for anchoring the door assembly. The anchor devices are usually metal such as aluminum or steel, but may also be heavy duty plastic or similar type material. The shape of the anchor device will vary depending on the installation requirements and will generally have a leg portion which is inserted into the frame member opening and a body portion which extends outward from the frame member. The anchor devices may be bendable to conform to the structure to which it is being secured and/or fabricated as part of the frame member of the door assembly which anchor device is then preferably bent from the frame member to the desired position and/or configuration when the door is to be installed.

In another aspect of the invention, the anchor device has a leveling boss in the body portion of the device. A bolt or other type device would be inserted (threaded) in the boss and used to level the door assembly during the installation by turning the bolt to adjust the height of the anchor device relative to the structure to which the door assembly is to be secured. An opening may also be provided in the body portion for bolting or otherwise securing the anchor device (and the attached frame) to the structure forming the opening.

In a further aspect of the invention, an anchor device is provided for use to secure a horizontal door at an opening wherein a leg portion of the anchor device is inserted into an opening in the frame member and the other body portion of the device extends outward from the wall.

In an additional aspect of the invention, the opening or recess in the frame member is a longitudinal slot running the length of the member so that the anchor device can be continuous or one or more anchor devices inserted at any point along the length of the frame member. This type frame member design is very economical from a manufacturing standpoint because the frame member would be extruded as a continuous member with the slot therein. In a preferred aspect of the invention, the frame member is provided with both a longitudinal recess and slot therein running along the outside of a wall of the frame member so that an anchor device can be installed at the factory with the body portion of the anchor device being contained within the recess and flush with the wall and the leg portion of the device being inserted in the slot. The anchor device can then be easily deformed on-site to form an outwardly extending anchor. An indentation in the wall is preferably provided at the terminal point of the anchor body portion of the device to allow bending of the anchor device outward from the frame member wall.

BRIEF DESCRIPTION OF THE DRAWINGS

For a full understanding of the invention, reference should be made to the following description taken in connection with the accompanying drawings in which.

DESCRIPTION OF THE PREFERRED EMBODIMENT

Figure 1:
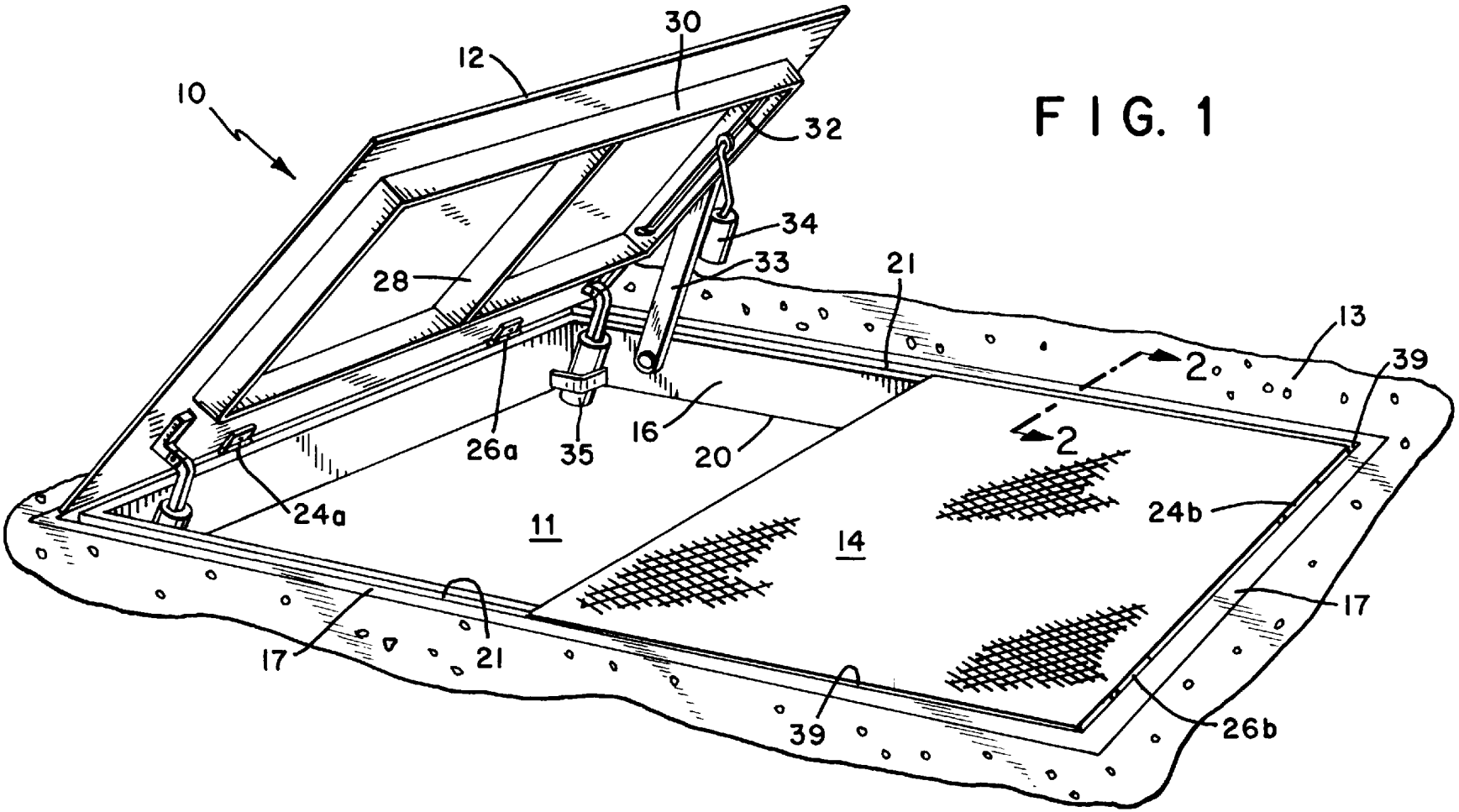
FIG. 1 is a perspective view of a double leaf, flush mounted door assembly, one leaf being open to show the peripheral channel frame member.

Referring to FIG. 1, a horizontal double leaf door assembly for enclosing an opening 11 according to the present invention is generally indicated by reference no.10. The assembly is shown cast-in-place in a concrete floor 13 which floor is at the same level as the door 12 and 14. One door leaf 12 is open to show the internal support structure and counterbalancing mechanism typical of these type door assemblies. Door leaf 14 is shown in the closed position. Door leaf 12 is shown horizontally hinged to flange 17 of an outer wall of channel frame 20 with hinges 24*a* and 26*a* and supported by spring lift mechanism 35. Inner wall 16 is lower than shoulder 17 and outer wall 15 (not shown) to accommodate the thickness of the door leaf 12 or 14. Door leaf 12 is shown with cross ribs 28 and long ribs 30 for support and L-slot 32 is provided to engage door handle 34, which is connected to support strut 33. Door leaf 14 is shown hinged to channel frame 15 by hinges 24*b* and 26*b*. A gap 39 is typically between the end of flange 17 and door 14 due to manufacturing tolerances and operational clearances. The gap 39 typically extends around the periphery of the door. The invention may also be used with single leaf doors as will be apparent to those skilled in the art.

Channel frame 20 has a channel 21 having an outer wall 15 (not shown) and an inner wall 16. The frame 20 extends around the periphery of the opening and the frame is generally formed by connecting frame members 20 together by welding at the corners.

Figure 2:
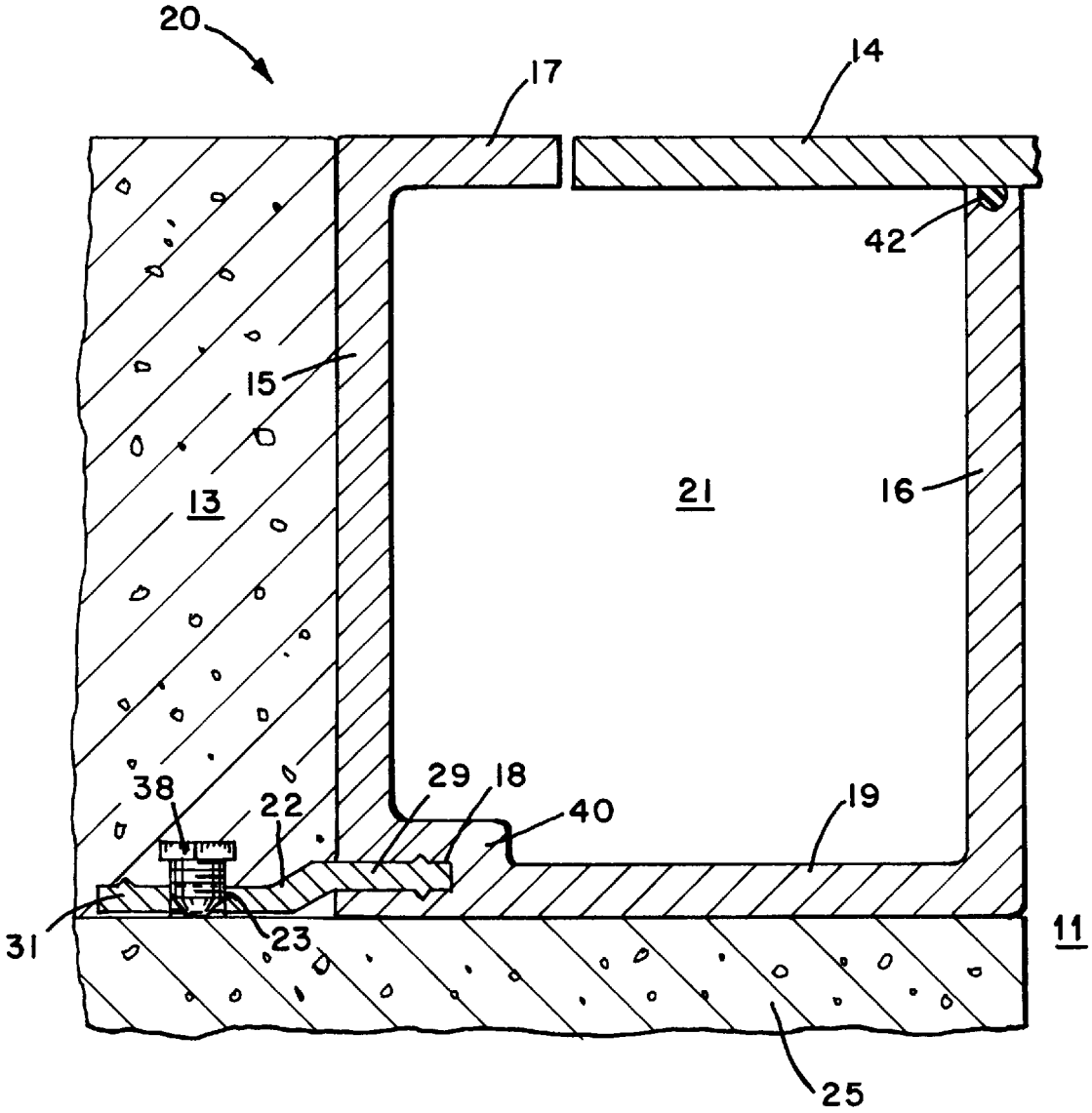
FIG. 2 is a partial cross-sectional side view along the line 2—2 in FIG. 1 showing the channel frame modified according to the present invention to accommodate an anchor device of the invention.

Referring to FIG. 2, door leaf 14 can be seen in the closed position. Channel frame 20 is secured in a poured-in-place concrete floor 13 which rests on a concrete structure base 25 defining opening 11. Leg portion 29 of anchoring device 22 is shown inserted in frame member opening 18 and an offset body portion 31 extends outward from outer wall 15 of the channel frame 20. The anchor device 22 has a leveling boss opening 23 which is shown threaded. Bolt 38 is threaded into opening 23 and is used to level the channel frame 20 and door assembly relative to concrete base 25. The channel frame 20 is preferably constructed with a thicker wall 40 where anchor device openings are to be provided. The wall portion is of a thickness sufficient to support the anchor device and will typically will be ¼ to ½ inch thick or thicker. The length of the leg portion 29 of the anchor device is up to about half the thickness or more of the wall 40 and the length of the body portion will vary up to about 2 inch, or more, usually 1 to 1 ½ inch. A gasket 42 is preferably disposed at the top of inner wall 16 to form a seal with door 14.

Figure 3:
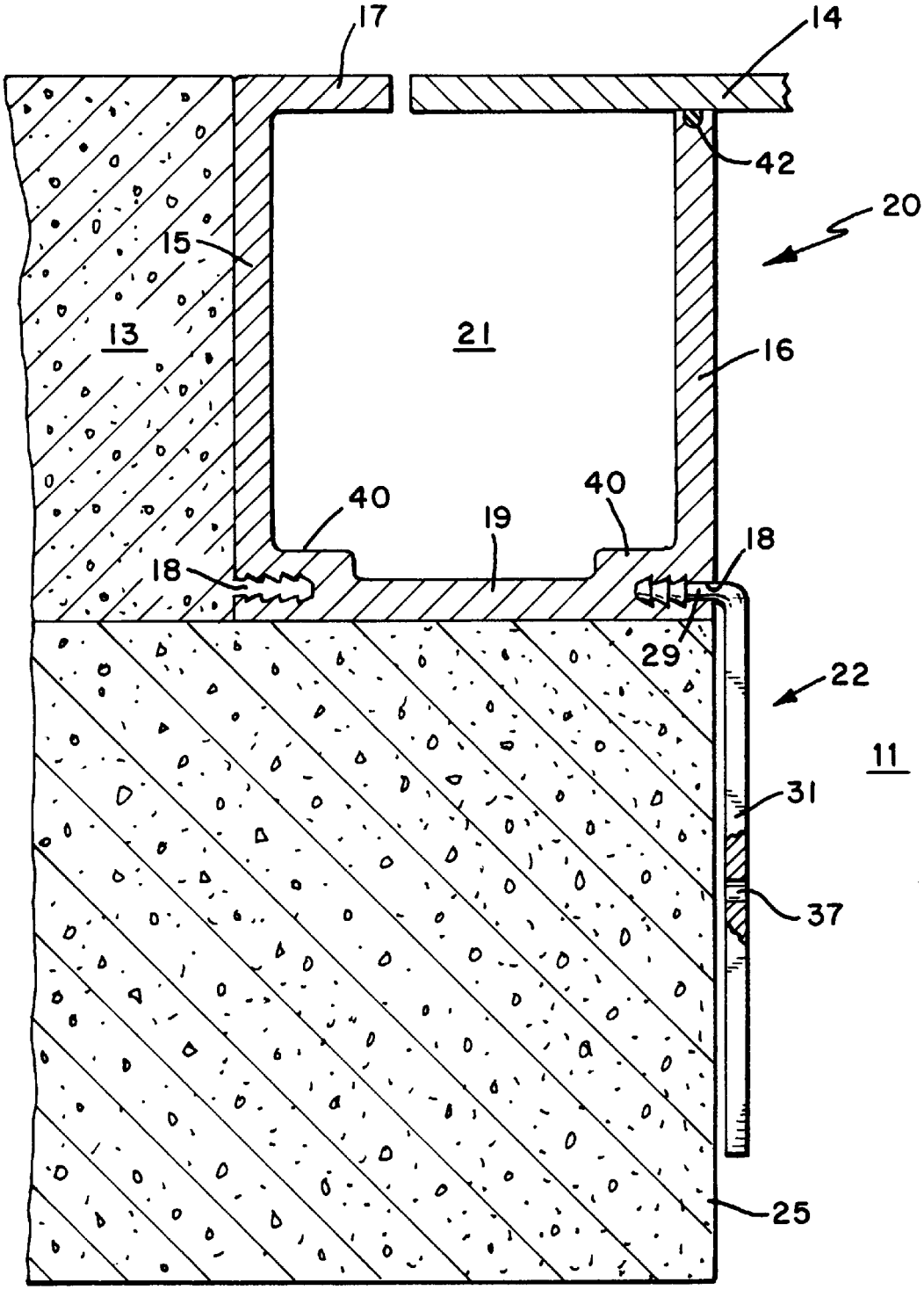
FIG. 3 is a side view showing another channel frame member modified according to the invention for securing the inner wall of the frame to the structure forming the opening.

Referring to FIG. 3, door leaf 14 is shown in the closed position. Channel frame 20 is secured on a structure 25 which may be a concrete slab, ceiling or floor. The channel frame 20 of the door assembly is placed on the upper surface of structure 25 and comprises an upper inwardly extending flange 17, an outer wall 15, a lower wall 19 and an inner side wall 16 having a gasket 42 at the upper end thereof. The channel frame 20 defines a channel opening 21. Barbed frame openings 18 in the channel frame 20 at thicker wall portions 40 are used with the anchor device 22 of the invention to secure the door assembly to structure 25. Thus, anchor device 22 is used to secure the door assembly to structure 25 by inserting leg portion 29 of anchor device 22 into frame opening 18. An elongated straight body portion 31 of anchor device 22 runs along the outer surface of structure 25 defining opening 11 to be covered and anchor device 22 is secured to structure 25 by a nail, screw, bolt or other fastener inserted through opening 37. The upper surface of structure 25 is then, if necessary, built up adjacent to channel frame 20 to the height of outer wall 15 and is shown generally as area 13. Cement, wood, or other structural material may be used.

Figure 4A:
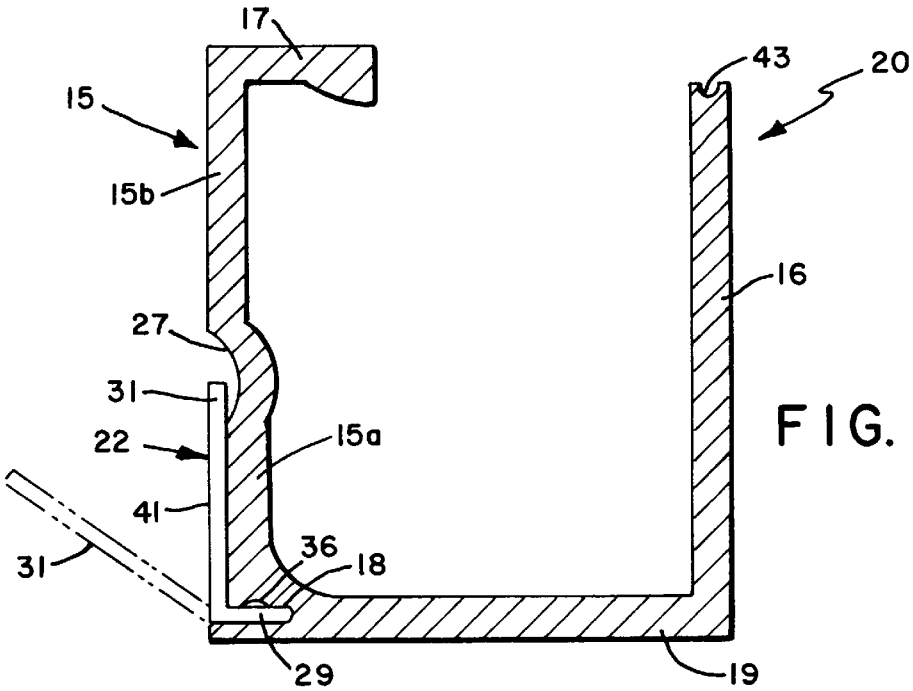
FIG. 4A is a side view showing another channel design of the invention.
Figure 4B:
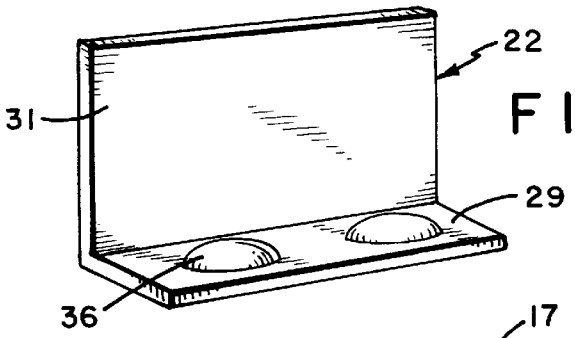
FIG. 4B is a perspective view of an anchor device of the invention.

Referring to FIGS. 4A and 4B, another channel frame member 20 of the invention is shown. Channel frame member 20 comprises an inwardly extending flange 17, an outer sidewall 15 having an upper portion 15*b* and lower inwardly offset portion 15*a*, a lower wall 19 and an inner wall 16 having an indentation 43 for a gasket. Outer wall 15 is configured to provide an indentation 27 and an inwardly recessed lower wall 15*a* to accommodate an anchoring device 22 of the invention. The anchoring device 22 is shown having a leg portion 29 which extends into opening 18 of frame 20 and a longer body portion 31 which extends in the recess along outer lower wall portion 15*a*. The outer surface 41 of anchor device 22 is flush with upper portion 15*b* of outer wall 15. This is a preferred design for shipping and safety purposes. Indentation 27 is used to permit bending of anchoring device 22 outward from wall 15 as shown in phantom. Any type lever could be used to bend anchor device 22 such as a screwdriver or crowbar. The outwardly extended anchor flange 22 is then in a position for securing the frame member 20 to a structure forming an opening to be covered as described hereinabove.

Referring to FIG. 4B, an anchor device 22 of the invention is shown. The anchor device 22 comprises a body portion 31 and a shorter transverse leg portion 29. Leg portion 29 has protrusions 36 thereon to provide a force fit in the opening in the frame securing the anchor device to the frame. In use, anchor flange 22 would be inserted into channel frame 20 by forcing leg portion 29 into the frame opening using a hammer or other such tool.

Figure 5:
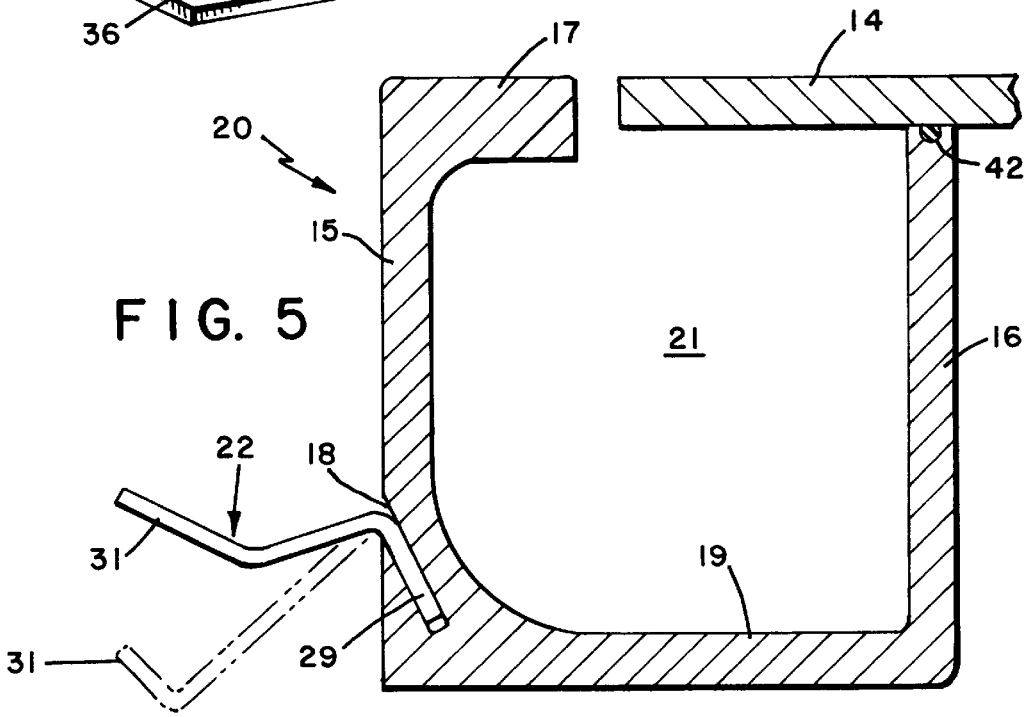
FIG. 5 is a side view showing another channel design and anchor device of the invention.

Referring to FIG. 5, a channel frame 20 of the invention is shown having an opening 18 in outer wall 15 which is at an angle to the vertical axis of outer wall 15. Anchor device 22 is shown having a leg portion 29 which is inserted into opening 18 and an angled body portion 31 which may be bent into any desired shape as shown in phantom in the figure.

As seen from the drawings, the door assembly of the present invention may be conventionally manufactured with the exception that the channel frame contains openings or recesses which are preferably formed in the frame member manufacturing (extrusion) process. The openings are preferably slots which run the length of the frame and which are easily made during an extrusion process forming the frame member. The anchor device 22 is manufactured separately and attached to the door assembly on-site by the installer or during fabrication of the door assembly. The anchor device may run the length of the frame member or a plurality of anchor devices may be used along the length of the frame member.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A horizontal hinged door assembly for enclosing an opening and which door assembly may be easily installed on-site, the door assembly comprising:

a plurality of elongate U-shape channel frame members having an inner wall, an outer wall and a connecting lower wall, wherein the inner wall of the frame member is shorter than the outer wall with both the outer wall and inner wall having free ends at their upper ends, which frame members are connected together to form a frame for the door assembly and which frame is secured to a structure forming the opening the frame members having at least one anchor opening in the outer surface of the outer wall of at least one of the frame members the outer wall being thicker at the anchor opening;

a hinge;

a door hingedly mounted to a frame member for motion between an open and closed position; and an elongate anchor device comprising a leg portion which is inserted into any of the anchor openings in the outer wall and a body portion which extends outwardly from the outer wall of the frame member and which body portion of the anchor device is secured to the structure forming the opening to provide an installed door assembly.

2. The horizontal hinged door assembly of claim 1 wherein the channel frame has a transverse inwardly extending flange at the upper free end of the outer wall to which the hinge is attached.

3. The horizontal hinged door assembly of claim 2 wherein a portion of the outer wall of the channel frame is offset to accommodate the body portion of the anchor device when the body portion is bent to fit into the offset so the outer wall of the bent anchor device is flush with the other non-offset portion of the outer wall of the channel frame.

4. The horizontal hinged door assembly of claim 3 wherein the outer wall of the channel frame is indented at the upper end of the bent anchor device to allow bending of the anchor device.

5. The hinged door assembly of claim 1 wherein the opening runs the length of the frame member.

6. The hinged door assembly of claim 1 wherein the body portion of the anchor device is bendable to conform to the structure forming the opening.

7. The hinged door assembly of claim 1 wherein the anchor device has a leveling boss in the body portion for leveling the door assembly.

8. The hinged door assembly of claim 1 wherein the anchor opening extends partly into the thicker portion of the outer wall.

9. The hinged door assembly of claim 1 wherein the opening in the outer wall is sized to hold the anchor device by a force fit.

10. A horizontal hinged door assembly for enclosing an opening and which door assembly may be easily installed on-site, the door assembly comprising:

a plurality of elongate U-shape channel frame members having an inner wall, an outer wall and a connecting lower wall wherein the outer wall is thicker at the lower end of the U-shape channel frame and forms part of the connecting lower wall, wherein the inner wall of the frame member is shorter than the outer wall with both the outer wall and inner wall having free ends at their upper ends, which frame members are connected together to form a frame for the door assembly and which frame is secured to a structure forming the opening, the frame members having at least one anchor opening or recess in the thicker portion of the outer surface of any or all of the outer walls of at least one of the frame members and which opening extends into the thicker portion of the outer wall;

a hinge;

a door hingedly mounted to a frame member for motion between an open and closed position; and an elongate anchor device comprising a leg portion which is inserted into any of the anchor openings in the outer wall and a body portion which extends outwardly from the outer wall of the frame member and which body portion of the anchor device is secured to the structure forming the opening to provide an installed door assembly.

11. The hinged door assembly of claim 10 wherein the anchor opening extends partly into both the thicker portion of the outer wall and the connecting lower wall.

* * * * *